United States Patent [19]

Stoner

[11] 4,027,415

[45] June 7, 1977

[54] AMMUNITION MAGAZINE

[75] Inventor: Eugene M. Stoner, Stuart, Fla.

[73] Assignee: Ares, Inc., Port Clinton, Ohio

[22] Filed: Sept. 2, 1975

[21] Appl. No.: 609,356

[52] U.S. Cl. ..... 42/50

[51] Int. Cl.[2] ..... F41C 25/04

[58] Field of Search ..... 42/50; 89/33 D, 33 B, 89/34

[56] References Cited

UNITED STATES PATENTS

| | | | |
|---|---|---|---|
| 601,097 | 3/1898 | Harle | 42/50 |
| 2,321,720 | 6/1943 | Whittaker | 42/50 |
| 3,087,270 | 4/1963 | Stoner | 42/50 |
| 3,906,652 | 9/1975 | Evans | 42/50 |

*Primary Examiner*—Stephen C. Bentley

*Attorney, Agent, or Firm*—Allan R. Fowler

[57] ABSTRACT

Disclosed is an ammunition magazine which may be made of plastic, pre-loaded with ammunition rounds and stored in the loaded condition for extended periods of time without deterioration. A spring motor is mounted on and drives an ammunition follower to urge the ammunition rounds toward the magazine's feed opening, and includes a drive gear which engages a gear rack formed on an interior wall of the magazine housing. The spring motor is disposed in an operationally unstressed condition during storage of the loaded magazine. To ready the magazine for use, a plastic strip having a gear rack formed thereon may be pulled from the bottom of the housing, thereby rotating an energizing gear which winds the spring motor to an operationally stressed condition.

6 Claims, 7 Drawing Figures

FIG. 3.
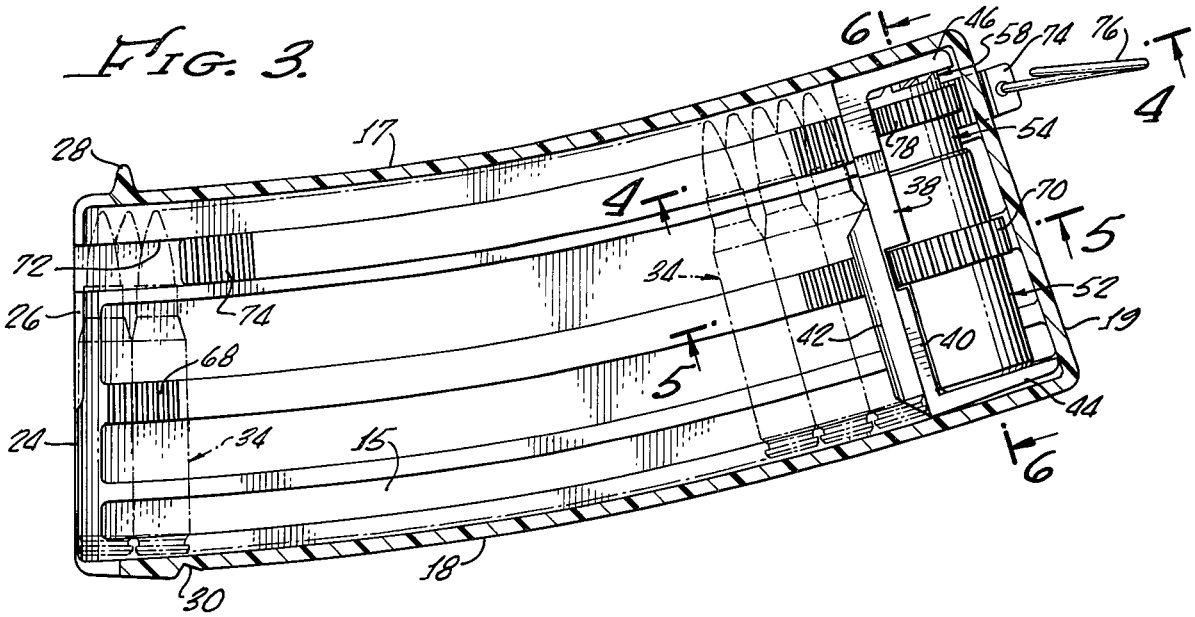
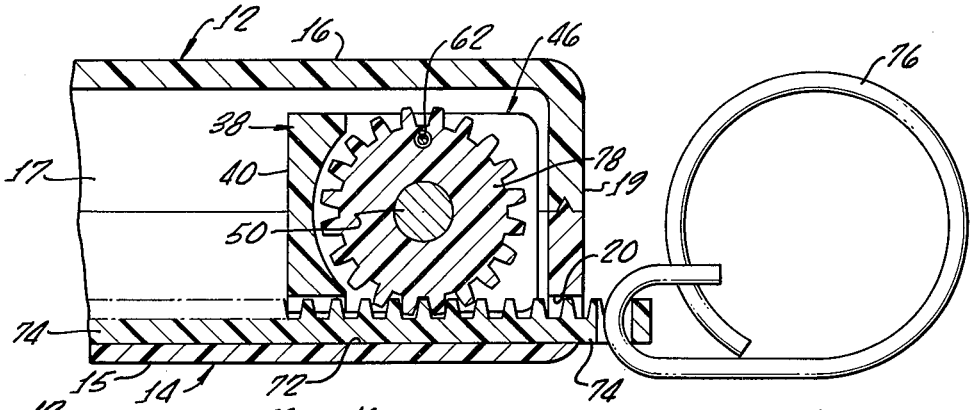
FIG. 4.
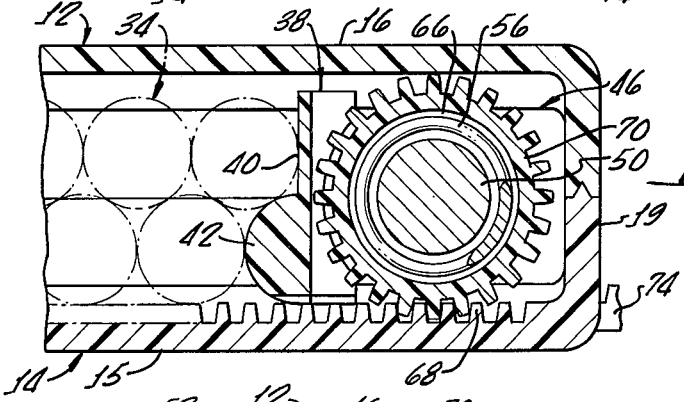
FIG. 5.
FIG. 6.
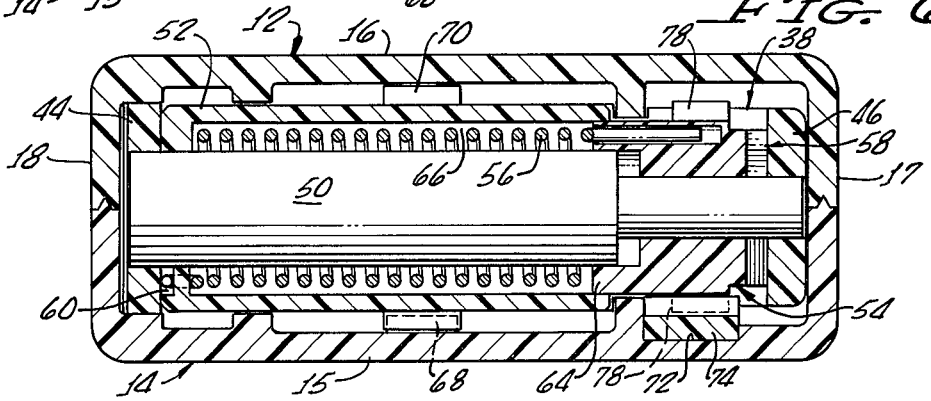

AMMUNITION MAGAZINE

The invention herein described was made in the course of a contract with the United States Department of the Navy.

This invention relates to ammunition magazines, and more specifically has reference to an ammunition magazine capable of being pre-loaded with rounds of ammunition and stored in the loaded condition for long periods of time without deterioration.

The typical conventional ammunition magazine utilizes a compression spring which expands through the magazine to supply the necessary force to urge a diminishing stack of ammunition rounds toward the ammunition feed opening of the magazine as the rounds are stripped from the magazine by the bolt of the gun on which the magzaine is mounted. Because of the requirement for long expansion through the magazine, the compression spring, even in its fully compressed condition, occupies a significant space thus significantly increasing the overall length of the magazine required for a given ammunition capacity. Further, since the spring is fully compressed when the magazine is loaded, storing a loaded magazine over an extended period of time can weaken or fatique the spring and cause the weapon utilizing the magazine to misfire because of improper feeding rounds of ammunition. Hence, the conventional magazine normally is stored, shipped and issued in an empty condition; and, prior to use on a gun it is necessary for the gunner to load the empty magazine by hand from separate stores of ammunition, supplied normally in special ammunition clips to aid such manual loading.

In accordance with the present invention, the magazine utilizes an ammunition follower to urge a stack of ammunition rounds toward the ammunition feed opening of the magazine. This is done with a spring mechanism; however, the spring mechanism is not stressed to a substantial degree when the magazine is loaded with ammunition rounds prior to use. Instead, manually accessible on the exterior of the magazine housing is a means for quickly energizing or stressing the spring mechanism at the time when the magazine is ready for use in a gun.

Thus, magazines pre-loaded with ammunition may be stored, transported and issued in the field, all without deteriorating the spring mechanism. The magazine is adapted to be pre-loaded with rounds of ammunition at the factory, stored in the loaded condition for extended periods of time and shipped in the loaded condition for use in the field, all without deterioration. The consequence is a more compact magazine for a given ammunition capacity, an increased efficiency in the field, and a substantial reduction in the logistics problems of procurement, storage and transportation. There is no need to ship and store magazines and ammunition rounds in separate packages.

Further, due to the substantially unstressed condition of the spring mechanism, hence the absence of high operational force stresses within the loaded magazine during storage, the magazine may be constructed of plastic without risking deformation during storage, such as deformation of the feed lips adjacent the feed opening which could occur in a stressed magazine. The ability to construct the magazine from plastic reduces the effects of corrosion, facilitates mass production, and offers the advantage of a wider choice of readily available raw materials for magazine construction.

In accordance with the most important and useful embodiment of the present invention the magazine utilizes, as a spring mechanism, a compact spring motor disposed initially in an operationaly unstressed condition, and is issued to the gunner fully loaded with ammunition. All that is necessary is for the gunner to energize the spring motor by the quick and simple manual means provided.

Briefly, the exemplary embodiment of an ammunition magazine according to the present invention combines an elongated hollow housing, which may be substantially filled with stacked ammunition rounds, with an ammunition follower that includes a spring motor operatively coupled to the housing for urging the ammunition follower along with the ammunition rounds toward an ammunition feed opening at the top end of the housing. The spring motor is disposed in an operationally unstressed condition; and, a means manually engageable from the exterior of the housing is provided for charging the spring motor to an operationally stressed condition.

In one exemplary embodiment of the invention, especially suited for mass production in plastic, the ammunition follower comprises a U-shaped frame which approximately spans the interior transverse cross-section of the housing and sideably engages portions of the interior of the housing for guidance. The frame has an upper face for engaging rounds of ammunition and a pair of downwardly extending spaced-apart legs for mounting the spring motor. The spring motor comprises a shaft extending transverse of the housing between the pair of legs, a rotatable drive member in the form of a drive gear journaled on the shaft, an energizing gear journaled on the shaft, and a helical torsion spring mounted concentric on the shaft. One end of the torsion spring is coupled to the drive gear, and the other end of the torsion spring is coupled to the energizing gear. the energizing gear is in turn coupled to the frame by means of a rachet so that it rotates only in the dircetion that increases stress on the torsion spring. The spring motor is operatively coupled to the housing by means of engagement of the drive gear with a gear rack formed on the interior of the housing and extending longitudinally thereof.

In this particular embodiment of the invention, the means for energizing the spring motor to an operationally stressed condition comprises an elongated strip member slideably mounted in a longitudinal slot formed in the housing, with the strip member having a gear rack formed thereon and disposed in engagement with the energizing gear. The strip member protrudes from the bottom of the housing and may be manually pulled out of the housing and discarded in a single quick motion, thereby rotating the energizing gear a sufficient amount to instantly energize the spring motor to an operationally stressed conditionn. Since the energizing gear turns only in this direction, the spring motor de-energizes only through the drive gear.

In the operationally stressed condition the magazine is ready for use with the spring motor urging the ammunition follower along with the ammunition rounds toward the ammunition feed opening. When the entire ammunition rounds have been expended and the spring motor de-energized the magazine may than be used again performing in the same manner as a conventional magazine with the insertion of ammunition rounds through the feed opening re-energizing the spring motor through the drive gear.

The foregoing and other features and advantages of the present inventin will be better understood by reference to the following description of an exemplary ammunition magazine illustrated in the accompanying drawings, in which:

FIG. 3 is a sectional view showing the interior of the magazine, taken along line 3—3 of FIG. 3;

FIG. 4 is a fragmentary sectional view taken at the location of the energizing gear along line 4—4 of FIG. 3;

FIG. 5 is a fragmentary sectional view taken at the location of the drive gear along line 5—5 of FIG. 3;

FIG. 6 is a sectional view along the axis of the spring motor, taken along line 6—6 of FIG. 3; and, FIG. 7 is an exploded fragmentary perspective view illustrating the rachet mechanism.

Figure 1:
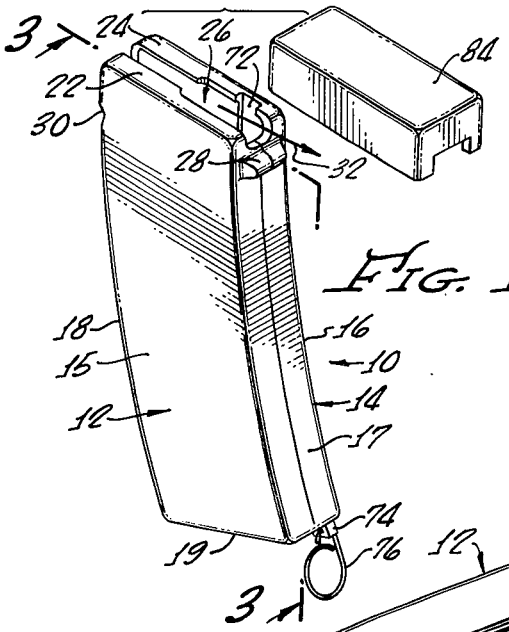
FIG. 1 is an exploded perspective view of an exemplary ammunition magazine and removeable cap therefor embodying the invention.

Referring now to the drawings, the exemplary ammunition magazine includes an elongated hollow housing 10, formed of two mating sections, a right section 12 and a left section 14. In the mated position as shown in FIG. 1, the two sections 12, 14 are bonded together to define right and left side walls 15, 16, front and rear edge walls 17, 18 and top and bottom end walls.

The bottom end wall 19 is substantially closed except for a small opening 20. the top end wall is formed by two ammunition feed lips 22, 24, of conventional configuration which define a feed opening 26 from which ammunition may be loaded and dispensed. The top of the magazine is adapted to be inserted into a gun (not shown) in a conventional manner, and to be releasably held in operative position in the gun by means of a stud 28 and a detent 30 formed respectively on the front and rear edge walls 17, 18 near the top of the housing. In a conventional manner, the bolt of the gun (not shown) reciprocates to strip successive ammunition rounds from the magazine through the feed opening 26 along the forward and upward direction of the arrow 32 shown in FIG. 1 as the gun is fired.

When assembled, the magazine housing 10 contains double stacked ammunition rounds 34 which substantially fill the housing and abut the ammunition feed lips 22, 24 at the top end of the housing; and, an ammunition follower having a U-shaped frame 36 is disposed interiorly of the housing adjacent the bottom end thereof in engagement with the bottom of the stack of ammunition rounds 34.

The ammunition follower U-shaped frame 36 has a cross member 38, the upper face 40 of which extends transversely of the longitudinal housing. A berm 42 extends along the left rear half of the upper face 40, so that the upper face 40 and berm 42 properly support and engage the double stacked ammunition rounds 34 at the bottom of the stack. The U-shaped frame 36 also includes a pair of spaced-apart legs 44, 46 which extend downwardly from opposite ends of the cross member 38. This shape for the ammunition follower gives it full stability and support for free sliding movement along the interior of the housing, with the side and end surfaces of the U-shaped frame cooperating in mating sliding engagement with interior portions of the side and edge walls respectively of the housing.

As seen in the drawings, the housing has relatively wide side walls, which are joined by relative narrow front and rear edge walls, thus forming the conventional elongated transverse cross-section for supporting stacked ammunition rounds, with the rounds of ammunition in the stack being disposed parallel to the side walls and approximately perpendicular to the end walls. The U-shape of the ammunition follower frame lies parallel to the housing side walls, with the downwardly extending legs 44, 46 of the U-shaped frame being disposed at the opposite ends of the cross member located proximate the rear and front edge walls 18, 17 respectively of the housing. Further, as is conventional, the housing is sector-shaped, or longitudinally curved, so as to accommodate the natural curvature of stacked ammunition rounds resulting from the tapered shape of most modern rounds.

The ammunition follower is driven by means of a spring mechanism in the form of a compact spring motor 48 mounted transversely of the housing between the downwardly extending legs 44, 46 of the U-shaped frame.

The spring motor 48 includes a mounting shaft 50 which extends between and is solidly mounted to the legs 44, 46 of the ammunition follower frame, a hollow rotary drive cylinder 52 rotatably journaled on the rear end of the shaft 50, an energizing cylinder 54 rotatably and slideably mounted on the front end of the shaft 50, a helical torsion spring 56 mounted coaxially on the shaft interiorly of the drive cylinder 52, and a rachet mechanism 58 coupling the energizing cylinder to the forward leg 46 of the follower frame.

The torsion spring 56 at its rear end is coupled to the drive cylinder 52 by means of extending into a slot 60 formed therein, and at its forward end is coupled to the energizing cylinder 54 by virtue of extending into a hole 62 formed therein.

The energizing cylinder 54 has a rearwardly extending skirt 64 the inner diameter of which matches the diameter of - shaft 64 the inner diameter of which matches the diameter the shaft 50 for rotatable and sliding movement thereon and the outer diameter of which matches the internal diameter of the drive cylinder 52 for rotary and sliding movement therein and in order to journal the forward end of the drive cylinder effectively to the shaft 50.

The torsion spring 56 is captured under compression between the drive clinder 52 and energizing cylinder 54, all within the confines of a cylindrical space 66 formed between the shaft 50 and the interior of the hollow drive cylinder 52, and therefore urges the energizing cylinder 54 toward the leg 46 of the follower frame so as to urge the rachet mechanism 58 into engagement.

Figure 2:
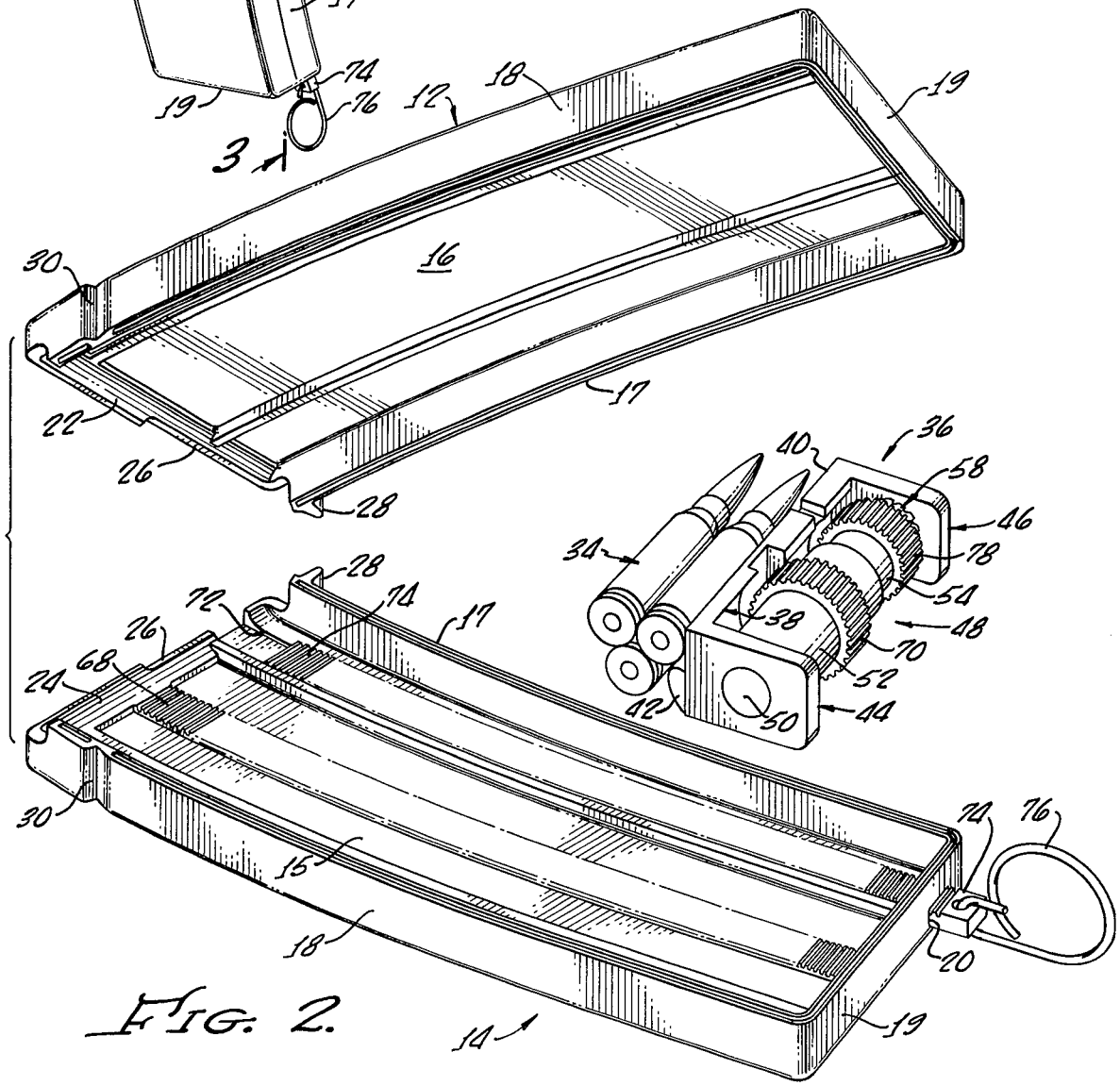
FIG. 2 is an exploded perspective view of the ammunition magazine of FIG. 1.

As best seen in FIGS. 2, 5, and 6, the left housing section 14 has a gear rack 68 formed on the interior its side wall 15. The gear rack 68 extends longitudinally along the housing between the bottom end 19 and the feed lip 24 thereof, or essentially from the bottom to the top of the housing The drive cylinder 52 of the spring motor is operatively coupled to the housing in driving relationship by means of a drive gear 70 formed on the perimeter thereof, which drive gear 70 engages the gear rack 68 formed on the interior of the side wall 15 of the housing.

An open channel 72 is formed long the interior of the left side wall 15 of the housing and extends longitudinally from top to bottom thereof parallel to the gear rack 68. This channel contains and guides a movable strip rack gear 74. The lower end of the movable strip rack gear 74 protrudes through the opening 20 in the bottom end wall 19 of the housing, and a pull ring 76 is attached to the protruding end so that the movable strip rack gear 74 is manually engageable from the exterior of the housing 10 to be pulled downwardly and out of the housing in a quick and easy motion.

The energizing cylinder 54 has an energizig gear 78 formed on the periphery thereof, and disposd in operable engagement with the gear teeth on the movable strip 74, so that when the strip is manually pulled out of the housing the energizing cylinder 54 rotates to wind the torsion spring 46 to its operationally stressed condition.

The forward end of the torsion spring 56 is effectively coupled to the follower frame by means of the energizing cylinder 54, the leg 46 of the frame and the intervening rachet mechanism 58, all under the influence of the compressed torsion spring 56.

Figure 7:
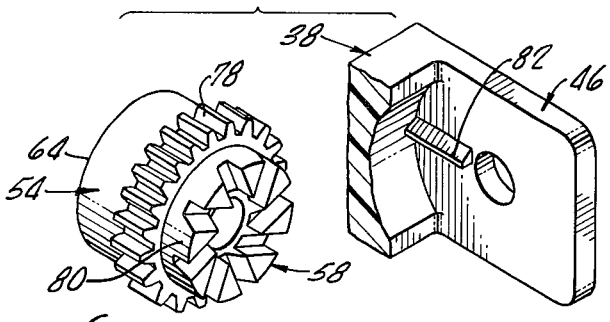

As best seen in FIG. 7, the rachet mechanism comprises a rachet 80 formed on the forward face of the energizing cylinder 54, which cooperates with a pawl 82 formed on the inside or rearwardly facing surface of the forward leg 46 of the follower frame. When the movable strip rack gear 74 is pulled from the housing, the energizing cylinder 54 reciprocates back and forth along the mounting shaft 50 under the influence of the compression of the torsion spring 56 to energize the torsion spring by winding it in the direction which places it in the operationally stressed condition. By virtue of the engagement of the rachet 80 with the pawl 82 however, the rachet will not permit rotation of the energizing cylinder 54 in the opposite direction, and therefore the torsion spring 56 remains energized until it can unwind as a result of rotation of the driving cylinder 52, which in turn cannot rotate until one or more of the stacked ammunition rounds 34 are stripped from the magazine.

As is apparent, the parts of the magazine can be made of plastic, such as by conventional injection molding of glass filled nylon. Where solid connections are required, the plastic can be heat welded by means of the application of well known ultrasonic processes. Of course the torsion spring 56 is metallic, but is well contained both within the housing and further within the space 66 interiorly of the hollow drive cylinder 52, the open end of which is occluded by the energizing cylinder 54. While the pull ring 76 is depicted as a metallic ring, it could as well be a loop of plastic material.

As seen in FIG. 1, a removable cap 84 may be provided to force fit onto the top end of the housing 10 for storage of the loaded magazine prior to use, and the opening 20 at the bottom end of the housing may be sealed around the removable strip rack gear 74 with a suitable sealing compund (not shown), so that prior to use, the housing and components and ammunition contained therein are hermetically sealed for long storage.

Furthermore, the construction features of this exemplary embodiment of my invention facilitates the process of assembly of the magazine with full loads of ammunition at the factory. Referring to FIG. 2, in the assembly process, prior to bonding the right and left housing sections 12, 14 together, the movable strip rack gear 74 and the ammunition follower 36 together with its attendant spring motor 48 mounted thereon are placed within the left housing section which is then filled with ammunition rounds, all through the use of conventional tools and jigs (not shown) suitable for mass production.

The ammunition follower 36 is initially placed in the left housing section with the spring motor in a partially energized condition, but not an operationally energized condition. The purpose for this is to hold the stacked rounds of ammunition 34 snugly in place within the housing during storage and handling and to minimize the length needed for the movable strip gear rack 74 to energize the spring motor to a fully operationally stressed condition.

In use, the gunner removes and discards the cap 84, charges the magazine by grasping the pull ring 76 and pulling the movable strip rack gear out of the housing to wind the spring motor to an operationally stressed condition, inserts the top end of the magazine into a gun (not shown), and proceeds to fire the gun. The movable strip rack gear 74 cannot be reinserted into the housing 10, and is discarded. However, after some or all of the ammunition rounds have been stripped from the magazine, rounds of ammunition can be reinserted through the feed opening 26 to reload the magazine in a conventional manner, thus driving the ammunition follower 36 downwardly in the magazine and thus recharging the spring motor through the drive gear 70.

As the bolt of the weapon (not shown) strips each ammunition round through the feed opening 26, the ammunition follower 36 under the influence of the operationally stressed spring motor and its drive gear urges the stack of rounds toward the feed opening thus positioning the next round adjacent the feed lips. As the ammunition rounds are progressively stripped from the magazine the ammunition follower approaches the top of the magazine under the influence of the spring motor and its drive gear, and the potential energy of the spring motor is thus expended.

The ammunition feed lips, 22, 24, feed opening 26 and stud 28 and detent 30 all located at the top of the magazine 10, are merely exemplary, and could be modified to fit any particular gun desired. Further, the shape of the magazine other than being elongated in a direction to accommodate stacked rounds of ammunition, could be modified, for example to accommodate a single stack of ammunition rounds rather than a double stack, all without departing from the present invention. Moreover, while advantages are obtained because the construction and operation of the magazine facilitates its manufacture in a plastic material, obviously the magazine components could also be constructed of metal, although significant advantages would be sacrificed.

It is intended that the exemplary magazine disclosed herein in detail be taken as illustrative only of the invention and not limiting of it in any manner.

What is claimed is:

1. An ammunition magazine adapted to be preloaded and stored for extended periods of time comprising, in combination:

an elongated sector-shaped hollow housing having top and bottom ends and having an ammunition feed opening at the top end;

the housing having opposite side walls, and front and rear edge walls joining said side walls;

a plurality of stacked ammunition rounds substantially filling said housing, the rounds of ammunition in the stack being disposed approximately parallel to said side walls;

a gear rack extending longitudinally of the housing along the interior of one of said side walls;

an ammunition follower moveable along the interior of said housing and disposed adjacent the bottom end thereof in engagement with the stack of ammunition rounds;

a spring motor mounted on said ammunition follower for movement therewith along the interior of the housing;

said spring motor including a rotary drive gear engaged with said gear rack for urging the ammunition follower along with the ammunition toward said ammunition feed opening;

said spring motor being disposed in an operationally unstressed condition;

said spring motor including a separate rotary energizing member, and means limiting rotation of the energizing member to the direction which places the spring motor in an operationally stressed condition; and, means manually engageable from the exterior of the housing for rotating said energizing member to energize said spring motor to an operationally stressed condition.

2. The apparatus of claim 1 wherein the means for rotating said energizing member to energize said spring motor to an operationally stressed condition comprises an elongated strip operatively coupled to said rotary energizing member of the spring motor and adapted to be manually pulled from the housing.

3. The apparatus of claim 1 wherein said ammunition follower comprises a U-shaped frame having an upper cross-member extending transversely of the housing for engaging said ammunition rounds and having a pair of downwardly extending legs disposed at opposite ends of the cross member proximate the front and rear edge walls of the housing, with the U-shape of the frame being disposed parallel to the side walls of the housing; and, wherein the spring motor is mounted transversely of the housing between said downwardly extending legs and comprises a shaft extending between and mounted to said legs, with said rotary drive gear being mounted on said shaft, a helical torsion spring mounted coaxially on said shaft, means coupling one end of said torsion spring to said drive gear, and means coupling the opposite end of said torsion spring to said frame.

4. An ammunition magazine adapted to be preloaded and stored for extended periods of time comprising, in combination:

an elongated hollow housing having top and bottom end and having an ammunition feed opening at the top end;

a plurality of stacked ammunition rounds substantially filling said housing;

ann ammunition follower moveable along the interior of said housing and disposed adjacent the bottom end thereof in engagement with the stack of ammunition rounds;

a spring motor mounted on said ammunition follower for movement therewith along the interior of the housing;

said spring motor including a rotary drive member operationally engaged with said housing for urging the ammunition follower along with the ammunition toward said ammunition feed opening;

said spring motor being diposed in an operationally unstressed condition;

said spring motor including an energizing gear; and, means manually engageable from the exterior of the housing for energizing said spring motor to an operationally stressed condition, said means for energizing including an elongated strip slidably mounted in the housing and protruding from the bottom end thereof, said strip having gear teeth formed along the length thereof, the gear teeth of said strip being in operational engagement with the energizing gear of the spring motor.

5. An ammunition magazine adapted to be preloaded and stored for extended periods of time comprising, in combination:

a elongated hollow housing having top and bottom ends and having an ammunition feed opening at the top end;

a plurality of stacked ammunition rounds substantially filling said housing;

an ammunition follower moveable along the interior of said housing and disposed adjacent the bottom end thereof in engagement with the stack of ammunition rounds, said follower having a U-shaped frame with an upper face for engaging said ammunition rounds, and a pair of downwardly extending legs;

a spring motor mounted transversly of the housing, on said ammunition follower between said downwardly extending legs, for movement therewith along the interior of the housing;

said spring motor being disposed in an operationally unstresed condition;

said spring motor including a shaft extending between and mounted to said legs, a rotary drive member mounted on said shaft and operationally engaged with said housing for urging the ammunition follower along with the ammunition toward said ammunition feed opening, a helical torsion spring mounted coaxially on said shaft, means coupling one end of said torsion spring to said drive member and means coupling the opposite end of said torsion spring to said frame;

said means coupling said opposite end if said torsion spring to the frame including a rotary energizing member mounted on said shaft and means limiting rotation of said energizing member to the direction which places the torsion spring in the operationally stressed condition;

said rotary energizing member being rotatably and slidably mounted on said shaft, and said torsion spring being compressed longitudinally against the energizing member and urging said energizing member against one leg of said frame said means limiting rotation of said energizing member to the direction which places the torsion spring in the operationally stressed condition comprising a ratchet mechanism disposed between the energizing member and said one leg of the frame; and, means manually engageable from the exterior of the housing for energizing said spring motor to an operationally stressed condition comprising an elongated member operatively coupled to said rotary energizing member and adapted to be manually pulled from the housing.

6. An ammunition magazine adapted to be preloaded with ammunition rounds and stored for extended periods of time while so loaded, comprising:

an elongated hollow housing having an opening at one end for loading and dispensing rounds of ammunition, said housing including a gear rack formed on a interior wall thereof and extending longitudinally of the housing;

an ammunition follower moveable along the interior of said housing from the other end of said housing;

drive means for urging the ammunition follower toward said opening, said drive means including a spring motor mounted on said ammunition follower for movement therewith, said spring motor being disposed in an operationally unstressed condition;

said spring motor including a drive gear engaged with said gear rack, a torsion spring, and an energizing gear coupled to said spring for energizing the same; and, means manually engageable from the exterior of the housing for energizing said spring motor to an operationally stressed condition after the magazine is loaded with ammunition, comprising an elongated strip slidably mounted in the housing and protruding from one end thereof, said strip having gear teeth formed along the length thereof, with the gear teeth of said strip being engaged with the energizing gear of said spring motor.

* * * * *